US010116024B2

(12) United States Patent
Shaman et al.

(10) Patent No.: US 10,116,024 B2
(45) Date of Patent: Oct. 30, 2018

(54) MICROSTRIP NOTCH FILTER WITH TWO-PRONGED FORK-SHAPED EMBEDDED RESONATOR

(71) Applicant: King Abdulaziz City for Science and Technology, Riyadh (SA)

(72) Inventors: Hussein N. Shaman, Riyadh (SA); Abdulrahman S. Alarifi, Riyadh (SA)

(73) Assignee: KING ABDULAZIZ CITY FOR SCIENCE AND TECHNOLOGY, Riyadh (SA)

( * ) Notice: Subject to any disclaimer, the term of this patent is extended or adjusted under 35 U.S.C. 154(b) by 105 days.

(21) Appl. No.: 15/151,914

(22) Filed: May 11, 2016

(65) Prior Publication Data

US 2017/0331167 A1 Nov. 16, 2017

(51) Int. Cl.
*H01P 1/203* (2006.01)

(52) U.S. Cl.
CPC ..... *H01P 1/203* (2013.01)

(58) Field of Classification Search
CPC ..... H01P 1/203
USPC ..... 333/204
See application file for complete search history.

(56) References Cited

U.S. PATENT DOCUMENTS 5,192,927 A * 3/1993 Lin ..... H01P 1/2039 333/204
5,969,584 A 10/1999 Huang et al.
6,191,666 B1 * 2/2001 Sheen ..... H03H 7/0115 333/185
7,138,884 B2 * 11/2006 Cheung ..... H01P 5/10 333/26
7,323,955 B2 1/2008 Jachowski
8,369,816 B2 2/2013 Ninan et al.
2010/0188167 A1 * 7/2010 Devereux ..... H01P 5/085 333/134
2014/0203894 A1 7/2014 Camillo-Castillo et al.
2015/0156642 A1 6/2015 Sobczak et al.
2017/0263993 A1 * 9/2017 Leray ..... H01P 1/203

OTHER PUBLICATIONS

Maharjan et al. "Compact microstrip square open-loop bandpass filter using open stub", Electronics Letters Mar. 15, 2012 vol. 48 No. 6, pp. 1-2.*
Wang et al. "Compact and high selectivity tri-band BPF using nested DDGSRs", Electronics Letters Mar. 29, 2012 vol. 48 No. 7, pp. 1-2.*
Tang et al. "Miniaturized wide stopband rejected microstrip filter with coupled spur-lines", Electronics Letters Mar. 2, 2006 vol. 42 No. 5, pp. 1-2.*
Lin et al. "Design of the Band-Pass Filter with Wide Stopband Performance Using I/4 Forked SIRs", 2009 Asia Pacific Microwave Conference, IEEE, pp. 1380-1382.*
(Continued)

*Primary Examiner* — Benny Lee
*Assistant Examiner* — Hafizur Rahman
(74) *Attorney, Agent, or Firm* — Andrew M. Calderon; Roberts Mlotkowski Safran Cole & Calderon, P.C.

(57) ABSTRACT

A notch filter includes a dielectric substrate, a microstrip transmission line on the dielectric substrate, and a fork-shaped open-circuited stub embedded in the microstrip transmission line.

20 Claims, 4 Drawing Sheets

(56) References Cited

OTHER PUBLICATIONS

Reja et al. "New Ultra-Wideband Filters Based on Tuning Forks Shape and CSRRs", 2014 IEEE International Conference on Aerospace Electronics and Remote Sensing Technology (ICARES), pp. 55-62.*

Sarkar et al., "Miniaturized UWB Bandpass Filter with . . . and Wide Upper Stopband", Progress in Electromagnetics Research Letters, vol. 38, pp. 161-170, 2013, 10 pages.

Zhang et al., "Band-Notched UWB Crossed Semi-Ring Mono-Pole Antenna", Progress in Electromagnetics Research C, vol. 19, pp. 107-118, 2011, 12 pages.

Shaman et al., "Ultra-Wideband (UWB) Bandpass Filter . . . Band Notch Structures", IEEE Microwave and Wireless Components Letters, vol. 17, No. 3, Mar. 2007, pp. 193-195, 3 pages.

* cited by examiner

MICROSTRIP NOTCH FILTER WITH TWO-PRONGED FORK-SHAPED EMBEDDED RESONATOR

FIELD OF THE INVENTION

The invention relates to notch filters, and more particularly, to notch filters with a two-pronged fork-shaped open-circuited stub.

BACKGROUND OF THE INVENTION

Notch filters, also commonly known as band-stop or band-rejection filters, reject a particular band of frequencies. Notch filters are also known as band elimination filters since they eliminate frequencies. The characteristics of a notch filter are essentially the inverse of the characteristics of a band pass filter. A notch filter has two cut-off frequencies (i.e. lower and upper cut-off frequencies) unlike high pass and low pass filters. The notch filter has two pass bands and one stop band. The notch filter passes signals above and below a determined range of frequencies (stop-band) and attenuates frequencies in between the cut-off frequencies.

Signal impurities naturally occur in radio frequency transmission technologies. These signal impurities, also known as spurious emissions, spurious harmonics, spurious signals, parasitic emissions, etc. are attenuated to reduce the effect on the transmission of corresponding data. The more spurious harmonics that are present in a frequency band, the fewer frequencies are available for use, e.g., for data transmission, cellular applications, radio transmission application, etc.

One technique to remove or attenuate spurious harmonics is to design wide band antennas to have narrow rejection bands. Alternatively, band-pass filters (BPFs) can be designed with single or multi narrow rejection bands. In general, this can be achieved by adding transmission line elements, such as conventional open-circuited stubs, whose electrical length is a quarter wavelength at the desired center frequency of the notched band. The characteristic impedance of the open-circuited stub is determined by the width of the structure.

The bandwidth of the notched band is directly proportional to the width of the open circuited stubs. Therefore, the physical width of the open circuited stub W becomes very small and difficult to fabricate, using conventional low cost printed circuit-board (PCB) technology, when narrow bandwidth is required. In addition, this technique increases the overall size of the design circuit board. To overcome these problems and to achieve a narrow notched band with realizable physical dimensions and small circuit size, spur lines and embedded open-circuited stubs can be implemented instead of conventional open-circuited stubs. The even and odd modes characteristic impedances of the spur line and embedded open-circuited stub are determined by the width and the gap which can be used to control the bandwidth of the notch.

Since spur lines and embedded open-circuited stubs are embedded into other components such as input and output feed lines, a notch can be generated without increasing the size of the circuit board. On the other hand, embedded open-circuited stub makes it possible to realize very high impedance. Hence, a very narrow rejection band can be achieved. However, the conventional open-circuited stub, spur line, and embedded open-circuited stub, whose electrical length is about a quarter wavelength long at the desired center frequency, have their spurious second harmonic at three times the center frequency of the notched band due to their distributed behavior. Since ultra-wide band (UWB) radio signals can cover a very wide band of frequency, i.e., from 3.1 gigahertz (GHz) to 10.6 GHz, the second harmonic might appear within the UWB allocated spectrum. For example, for WiMAX applications operating at the 3.5 GHz, the second harmonic when using conventional distributed components can appear at or below 10.5 GHz.

SUMMARY OF THE INVENTION

In a first aspect of the invention, there is a notch filter comprising: a dielectric substrate; a microstrip transmission line on the dielectric substrate; and a fork-shaped open-circuited stub embedded in the microstrip transmission line.

In another aspect of the invention, there is a notch filter comprising: a dielectric substrate; and a microstrip transmission line provided on the dielectric substrate and having a fork-shaped open-circuited stub etched through the microstrip transmission line, wherein the fork-shaped open-circuited stub exposes the underlying dielectric substrate.

In another aspect of the invention, there is a micro strip transmission line comprising an embedded fork-shaped open-circuited stub, wherein the fork-shaped open-circuited stub comprises a stem, a base, a first prong, and a second prong defined by perimeter legs and an open area.

BRIEF DESCRIPTION OF THE DRAWINGS

The present invention is described in the detailed description which follows, in reference to the noted plurality of drawings by way of non-limiting examples of exemplary embodiments of the present invention.

DETAILED DESCRIPTION OF THE INVENTION

The invention relates to notch filters, and more particularly, to notch filters with a two-pronged fork-shaped open-circuited stub. In accordance with aspects of the present invention, a notch filter with a two-pronged fork-shaped open-circuited stub increases the distance between spurious harmonics in a given frequency band, and therefore increases the available frequencies for use. Increasing the distance between spurious harmonics in a given frequency band is particularly advantageous in ultra-wide band (UWB) environments, e.g., wireless communication environments, since wider bands potentially have more spurious harmonics than narrower bands.

In accordance with aspects of the present invention, a notch filter with a fork-shaped open-circuited stub increases the distance between spurious harmonics from a distance of three times of a center frequency to eight times of a center frequency. As a result of the increased distance between spurious harmonics, fewer signal impurities exist in a frequency band, and more frequencies can be used, e.g., for data transmission, wireless communication, etc.

Figure 1A:
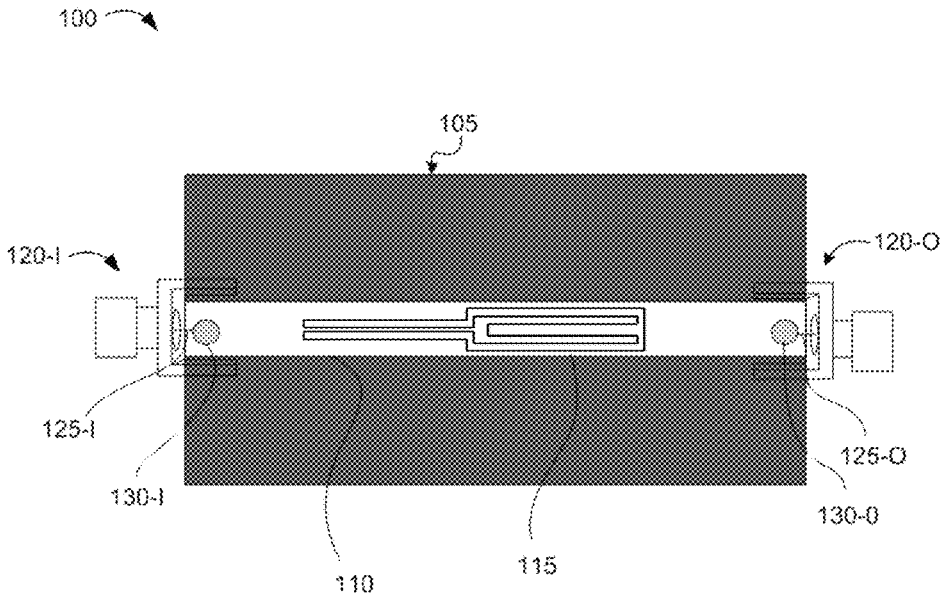
FIG. 1A shows a top view of a notch filter in accordance with aspects of the present invention.

FIG. 1A shows a top view of a notch filter in accordance with aspects of the present invention. As shown in FIG. 1A, a notch filter 100 includes a dielectric substrate 105, a microstrip transmission line 110, a fork-shaped open-circuited stub 115, an input connection 120-I, and an output connection 120-O. The dielectric substrate 105 may be constructed from one more dielectric materials, such as glass microfiber polytetrafluoroethylene (PTFE) composites and/or other dielectric materials. In embodiments, the dielectric substrate 105 may have an effective dielectric constant of approximately 2.2, although the dielectric constant may differ for various embodiments. In some embodiments, the dielectric substrate 105 may have a thickness of approximately 1.27 millimeters (mm) to approximately 1.585 millimeters, although the thickness may differ for various embodiments. The microstrip transmission line 110 may have a thickness of approximately 0.017 mm, although the thickness may differ for various embodiments.

The microstrip transmission line 110 may include a copper, a copper alloy, and/or other electrically conductive material(s). In embodiments, the microstrip transmission line 110 may have a resistance of 50 ohms, although microstrip transmission line 110 may have a different resistance. The microstrip transmission line 110 is provided on a first side, e.g., a top side, of the dielectric substrate 105. A ground plane conductor is provided on a second side, e.g., an underside, of the dielectric substrate 105. The fork-shaped open-circuited stub 115 may be formed by etching or removing the microstrip transmission line 110 in the shape of a fork. For example, the material of the microstrip transmission line 110 is etched or removed, e.g., using laser ablation or chemical etching such as reactive ion etching (RIE), to expose the top side of the underlying dielectric material of the dielectric substrate 105.

As further shown in FIG. 1A, an input connection 120-I includes an input terminal 125-I which is connected to the microstrip transmission line 110 via an input connection 130-I, which may be a solder connection. The input connection 120-I may include any type of connector, such as a coaxial connector, an SMA connector, or the like. An output connection 120-O includes an output terminal 125-O which is connected to the microstrip transmission line 110 via an output connection 130-O, which may be a solder connection. The output connection 120-O may include any type of connector such as a coaxial connector, a SubMiniature version A (SMA) connector, or the like. The input connection 120-I connects to a transmitting device whereby data is transmitted via the microstrip transmission line 110 and to a receiving device via output connection 120-O.

Figure 1B:
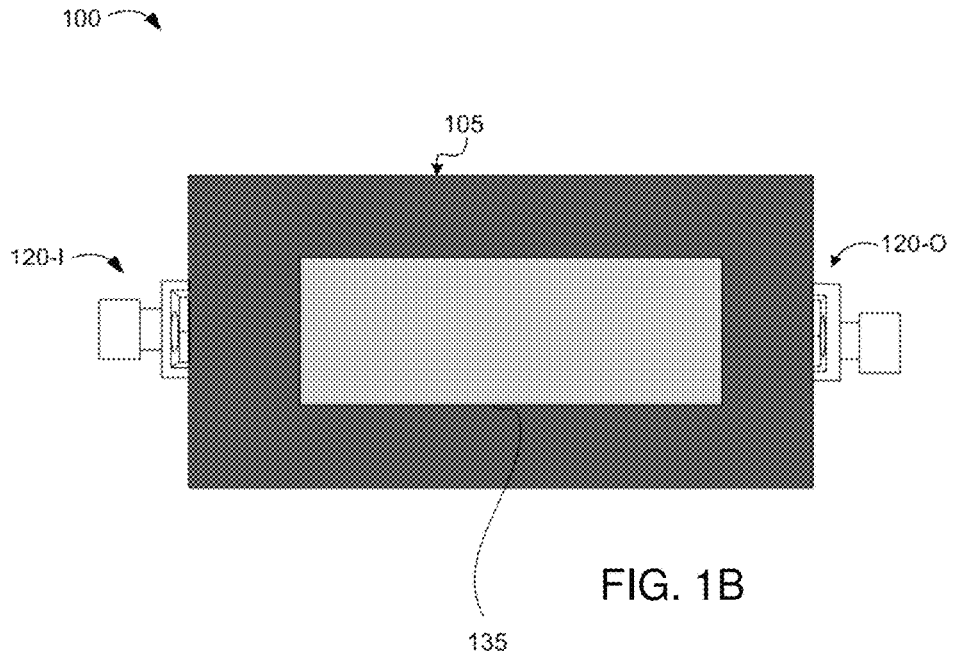
FIG. 1B shows a bottom view of the notch filter in accordance with aspects of the present invention.

As shown in FIG. 1A, the microstrip transmission line 110 is mounted on a first surface, e.g., a top surface, of the dielectric substrate 105. One end of the microstrip transmission line 110 is connected to the input connection 120-I and the second end is connected to the output connection 120-O. A ground plane conductor is placed on a second surface, e.g., a bottom surface or underside, of the dielectric substrate 105 as shown in FIG. 1B. As described herein, the fork-shaped open-circuited stub 115 is etched in microstrip transmission line 105, e.g., via laser etching, chemical etching, and/or other etching process. The electrical length of the embedded open-circuited stub 115 with a two-pronged fork shape is approximately a quarter wavelength at the center frequency of the notched band. As described here, when data is transmitted via the notch filter 100, e.g., from the input to the output, the fork-shaped open-circuited stub 115 increases the distance between spurious harmonics. The microstrip layout of the notch filter 100 constructed in accordance with aspects of the present invention is symmetric with respect to the y-axis.

FIG. 1B shows a bottom view of a notch filter in accordance with aspects of the present invention. As shown in FIG. 1B, a second side of the dielectric substrate 105, e.g., a bottom side or underside, includes a ground plane 135. The ground plane 135 may be a single flat surface. Alternatively, the ground plane 135 may differ in size and shape than shown in FIG. 1B. In embodiments, the dielectric substrate 105 may include multiple ground planes 135 of various shapes and sizes.

Figure 2:
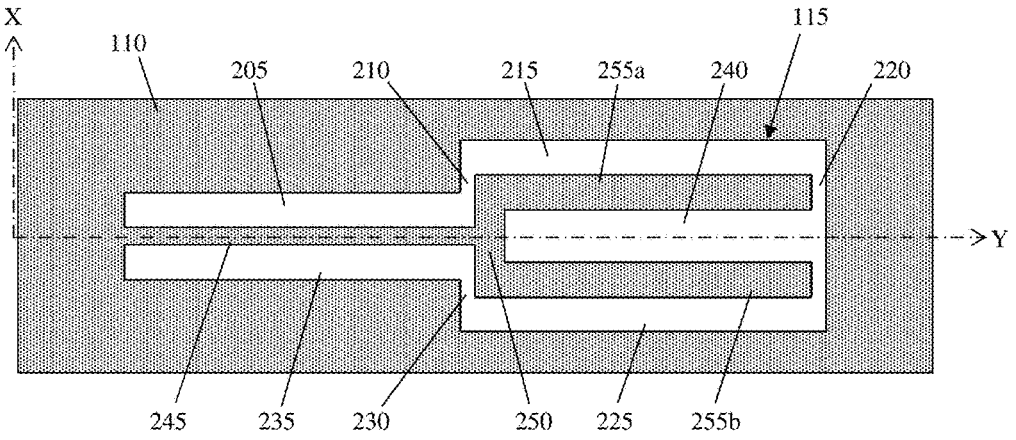
FIG. 2 shows a top view of a microstrip transmission line with a fork-shaped open-circuited stub in accordance with aspects of the present invention.

FIG. 2 shows a top view of the microstrip transmission line 110 in accordance with aspects of the present invention. The view shown in FIG. 2 is a diagrammatic view and is not to scale. As shown in FIG. 2, the microstrip transmission line 110 is etched in the shape of a fork to form the fork-shaped open-circuited stub 115, thereby exposing the underlying dielectric substrate 105. As further shown in FIG. 2, the fork-shaped open-circuited stub 115 includes seven perimeter legs, e.g., legs 205, 210, 215, 220, 225, 230, and 235. The perimeter legs are areas where the material of microstrip transmission line 110 has been removed (e.g., by etching) to expose the underlying dielectric substrate 105. Legs 205, 215, 225, and 235 are substantially parallel to each other and arranged along a direction of a y-axis. Legs 210, 220, and 230 are arranged along a direction of an x-axis and are substantially perpendicular to legs 205, 215, 225, and 235. Area 240 is an interior area where the material of microstrip transmission line 110 has been removed, e.g., similar to the perimeter legs. The legs 205, 210, 215, 220, 225, 230, and 235 and the interior area 240 define the two-pronged fork-shaped open-circuited stub 115 that comprises a stem 245, a base 250, a first prong 255*a*, and a second prong 255*b*.

In accordance with aspects of the invention, each of the stem 245, base 250, first prong 255*a*, and second prong 255*b* are formed of the material of the microstrip transmission line 110. A proximal end of the stem 245 is connected to the microstrip transmission line 110. A distal end of the stem 245 is connected to the base 250. A proximal end of the first prong 255*a* and a proximal end of the second prong 255*b* are each connected to the base 250. A distal end of the first prong 255*a* ends in a first open circuit termination, and a distal end of the second prong 255*b* ends in a second open circuit termination. The stem 245, base 250, first prong 255*a*, and second prong 255*b* are surrounded by other material of the microstrip transmission line 110, such that the two-pronged fork-shaped open-circuited stub 115 is said to be embedded in the microstrip transmission line 110.

Figure 3:
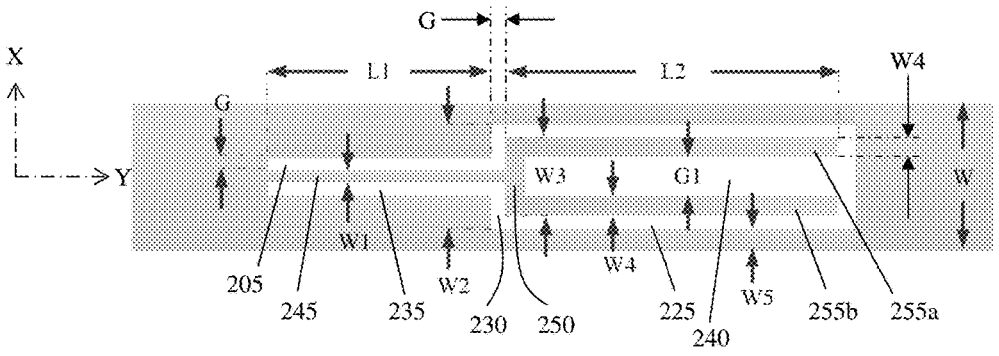
FIG. 3 shows dimensions of a fork-shaped open-circuited stub in accordance with aspects of the present invention.

FIG. 3 shows a top view of the microstrip transmission line 110 and example dimensions of components of the notch filter in accordance with aspects of the present invention. As shown in FIG. 3, the fork-shaped open-circuited stub 115 includes the lengths L1 and L2, widths W1, W2, W3, W4, W5, and gaps G, G1. The microstrip transmission line 110 includes an overall width W in the x-direction. As shown in FIG. 3, the gap G is a width in the x-direction of the perimeter legs 205, 215, 225, and 235. The gap G is also the width in the y-direction of the perimeter legs 210, 220, 230. The gap G1 is a width in the x-direction of the open area 240. The length L1 is a length in the y-direction of a portion of the fork-shaped open-circuited stub 115 having parallel perimeter legs, e.g., legs 205 and 235. The length L2 is a horizontal length in the y-direction of each of the first prong 255*a* and second prong 255*b*. The width W1 defines a width of the stem 245 in the x-direction, between parallel perimeter legs of the fork-shaped open-circuited stub 115, e.g., legs 205 and 235. The width W2 defines the width of a step that forms the fork shape of the fork-shaped open-circuited stub 115, e.g., a distance in the x-direction between an outermost edge of leg 210 and an outermost edge of leg 230. The width W3 is a dimension in the x-direction between the outer surfaces of the first prong 255*a* and the second prong 255*b*. The width W4 is a width in the x-direction of each of the first prong 255*a* and the second prong 255*b*. The width W5 defines a width in the x-direction of a portion of the microstrip transmission line 110 that surrounds the fork-shaped open-circuited stub 115.

The dimensions of lengths L1 and L2 can be selected based on a desired center frequency of a notched band. The dimension of the gaps G and G1 can be selected based on a desired width of the resonant frequency of the first spurious harmonic, e.g., the center frequency of the notched band. Also, the dimensions of the gaps G and G1 can be selected to control the bandwidth of the notch. Thus, the gaps G and G1 can be selected to balance the benefits of a reduced resonant frequency width with the benefits of the distance between spurious harmonics.

By way of non-limiting, illustrative example, approximate measurements of the dimensions include: W=5.0 mm, W1=0.2 mm, W2=4.0 mm, W3=3.4 mm, W4=1.1 mm, W5=0.5 mm, G=0.3 mm, G1=1.2 mm, L1=12.2 mm, and L2=24.0 mm. Using these exemplary dimensions, a width of each prong 255*a*, 255*b* in the x-direction is about 1.1 mm, and a length in a y-direction from a proximal end of the stem 245 to the distal end of the prongs 255*a*, 255*b* about 36.5 mm. The example dimensions are provided for a particular implementation of the notch filter formed in a 50-Ohm microstrip transmission line, wherein the notch filter generates a notch with a very narrow bandwidth at a center frequency of about 1.0 GHz, has a level of rejection of more than −35.0 dB (as shown in FIG. 4), and has a second harmonic at more than eight times the center frequency of the notched band (as shown in FIG. 5).

It should be noted that the notch filter 100 is not limited to operate at this particular frequency, and the example dimensions are for illustrative purposes only. The notch filter 100 can be modified to operate at any desired operating frequency within the limitations of the dielectric substrate 105. In addition, the number of the embedded open-circuited resonator and the materials used for the dielectric substrate 105 or the microstrip transmission lines 110 can also be modified to meet specific requirements. Since the notch filter 100 includes only one embedded fork-shaped open circuited stub 115, the notch filter 100 behaves as a single pole filter. The number of the embedded fork-shaped open-circuited stubs 115 defines the number of poles the notch filter 100 has. Thus, the notch filter 100 is not limited to the layout shown in which only one fork-shaped open-circuited stub 115 is provided.

Figure 4:
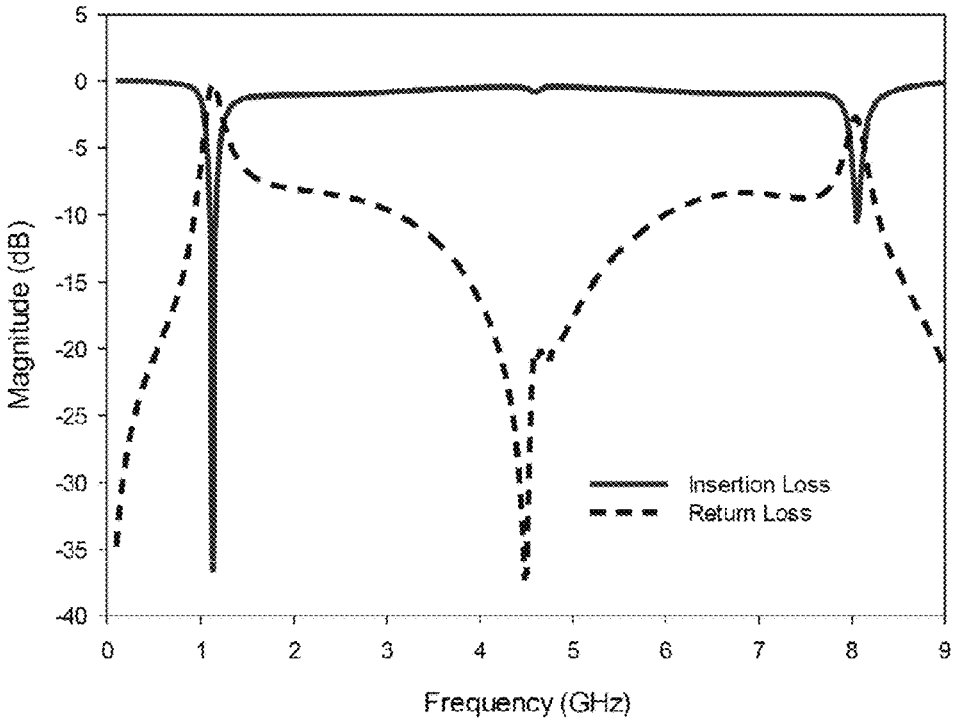
FIG. 4 shows a graph of insertion loss and return loss using the notch filter in accordance with aspects of the present invention.

FIG. 4 shows a graph of simulated values of insertion loss and return loss of the exemplary implementation of the notch filter 100. The simulated insertion loss and return loss data can be obtained, for example, using any variety of known electromagnetic (EM) simulation techniques. As shown in FIG. 4, a narrow notched band is obtained at a frequency of approximately 1.0 GHz with a level of rejection of approximately −35.0 dB. As further shown in FIG. 4, the second harmonic appears at more than eight times the center frequency of the notched band, e.g., at approximately 8.0 GHz units, unlike similar existing resonators such as conventional open-circuited stub, spur-line resonator, and embedded open stub with uniform shape whose second spurious harmonic appears at only three times the center frequency. The advantages of shifting the undesired second spurious harmonic up to more than eight times (8×) the center frequency of the notch in addition to the narrow rejection band make the notch filter 100 ideal for many applications, such as UWB applications, e.g., wireless communication systems and/or other systems in which a wide band of frequencies are used. For example, as a result of the increased distance between spurious harmonics, fewer signal impurities exist in a frequency band, and more frequencies can be used, e.g., for data transmission, wireless communication, etc.

Figure 5:
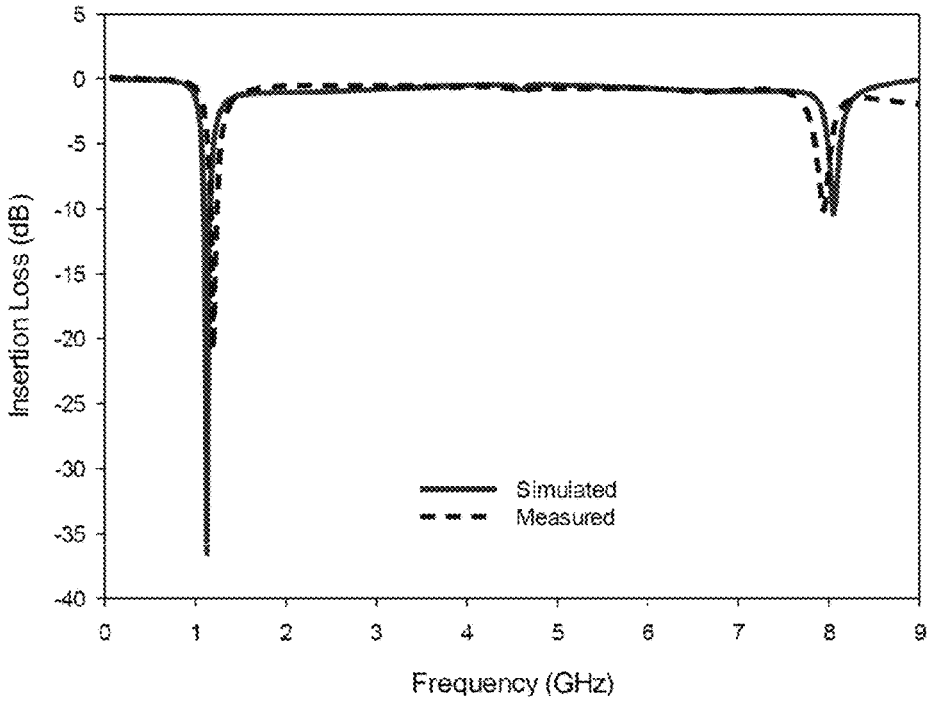
FIG. 5 shows a graph comparing measured insertion loss with simulated insertion loss for the notch filter in accordance with aspects of the present invention.

FIG. 5 shows a graph comparing measured insertion loss with simulated insertion loss for the notch filter 100. As shown in FIG. 5, the measured insertion loss has a rejection level of more than −15 decibels (dB) at the center frequency of the notched band compared to a simulated frequency of approximately −35 dB at the center frequency.

The foregoing examples have been provided for the purpose of explanation and should not be construed as limiting the present invention. While the present invention has been described with reference to an exemplary embodiment, Changes may be made, within the purview of the appended claims, without departing from the scope and spirit of the present invention in its aspects. Also, although the present invention has been described herein with reference to particular materials and embodiments, the present invention is not intended to be limited to the particulars disclosed herein; rather, the present invention extends to all functionally equivalent structures, methods and uses, such as are within the scope of the appended claims.

What is claimed:

1. A notch filter comprising:
a dielectric substrate;
a microstrip transmission line on the dielectric substrate; and
a fork-shaped open-circuited stub embedded in the microstrip transmission line,
wherein for a signal transmitted via the microstrip transmission line, the fork-shaped open-circuited stub causes a second spurious harmonic in the signal to be at approximately eight times a center frequency in which a first spurious harmonic is present.

2. The notch filter of claim 1, wherein seven perimeter legs and an open area define a stem, a base, a first prong, and a second prong of the fork-shaped open-circuited stub.

3. The notch filter of claim 2, wherein each of the stem, the base, the first prong, and the second prong is formed of the material of the microstrip transmission line.

4. The notch filter of claim 2, wherein:
a proximal end of the stem is connected to the microstrip transmission line;
a distal end of the stem is connected to the base;
a proximal end of the first prong is connected to the base;
a proximal end of the second prong is connected to the base;
a distal end of the first prong ends in a first open-circuit termination; and
a distal end of the second prong ends in a second open-circuit termination.

5. The notch filter of claim 2, wherein the fork-shaped open-circuited stub is symmetric about a y-axis.

6. The notch filter of claim 2, wherein:
a width of the stem in an x-direction is about 0.2 mm;

a width of each of the first prong and the second prong in the x-direction is about 1.1 mm;

a width of a surrounding portion of the microstrip transmission line in the x-direction is about 0.5 mm;

an overall width of the microstrip transmission line in the x-direction is about 5.0 mm; and a width of the open area in the x-direction between the first prong and the second prong is about 1.2 mm.

7. The notch filter of claim 6, wherein a length in a y-direction from a proximal end of the stem to the distal end of the first prong is about 36.5 mm.

8. The notch filter of claim 1, further comprising a ground plane conductor on an opposite side of the dielectric substrate as the microstrip transmission line.

9. The notch filter of claim 1, wherein a thickness of the microstrip transmission line is approximately 0.017 mm and the thickness of the dielectric substrate is approximately 1.27 mm to approximately 1.585 mm.

10. A notch filter comprising:

a dielectric substrate; and a microstrip transmission line provided on the dielectric substrate and having a fork-shaped open-circuited stub etched through the microstrip transmission line, wherein the fork-shaped open-circuited stub exposes the dielectric substrate, wherein for a signal transmitted via the microstrip transmission line, the fork-shaped open-circuited stub causes a second spurious harmonic in the signal to be at approximately eight times a center frequency in which a first spurious harmonic is present.

11. The notch filter of claim 10, further comprising a ground plane conductor on an opposite side of the dielectric substrate as the microstrip transmission line.

12. The notch filter of claim 10, wherein the fork-shaped open-circuited stub includes perimeter legs and an open area that define a stem, a base, a first prong, and a second prong of the fork-shaped open-circuited stub.

13. The notch filter of claim 12, wherein each of the stem, the base, the first prong, and the second prong is formed of the material of the microstrip transmission line.

14. The notch filter of claim 12, wherein:

a proximal end of the stem is connected to the microstrip transmission line;

a distal end of the stem is connected to the base;

a proximal end of the first prong is connected to the base;

a proximal end of the second prong is connected to the base;

a distal end of the first prong ends in a first open-circuit termination; and a distal end of the second prong ends in a second open-circuit termination.

15. The notch filter of claim 10, wherein a thickness of the microstrip transmission line is approximately 0.017 mm and the thickness of the dielectric substrate is approximately 1.27 mm to approximately 1.585 mm.

16. A microstrip transmission line comprising an embedded fork-shaped open-circuited stub, wherein the fork-shaped open-circuited stub comprises a stem, a base, a first prong, and a second prong defined by perimeter legs and an open area, wherein the microstrip transmission line extends along a y-axis between an input and an output;

the fork-shaped open-circuited stub is symmetric about the y-axis; and the stem is a single microstrip element that is on and symmetric about the y-axis.

17. The microstrip transmission line of claim 16, wherein for a signal transmitted via the microstrip transmission line, the fork-shaped open-circuited stub causes a second spurious harmonic in the signal to be at approximately eight times a center frequency in which a first spurious harmonic is present.

18. The microstrip transmission line of claim 16, wherein a length of the stem along the y-axis is less than a length of each of the first prong and the second prong along the y-axis.

19. The microstrip transmission line of claim 16, wherein:

the microstrip transmission line comprises a metal on a dielectric material;

the stem, the base, the first prong, and the second prong are composed of the metal on the dielectric material; and the perimeter legs and the open area comprise areas where the metal has been removed from the dielectric material.

20. The microstrip transmission line of claim 16, wherein a width of the stem in an x-direction perpendicular to the y-axis is less than a width of each of the first prong and the second prong in the x-direction.

* * * * *